United States Patent [19]

Ratliff

[11] 4,428,328

[45] Jan. 31, 1984

[54] STEAM BOILER HEAT RECOVERY APPARATUS

[75] Inventor: Richard L. Ratliff, Indianapolis, Ind.

[73] Assignee: Don Lee Supply, Inc., Indianapolis, Ind.

[21] Appl. No.: 322,472

[22] Filed: Nov. 18, 1981

[51] Int. Cl.[3] ..... F22B 37/48; F28G 13/00

[52] U.S. Cl. ..... 122/396; 122/504; 374/40

[58] Field of Search ..... 122/451.1, 504, 396, 122/403, 4 R, 1 C; 165/11 R; 374/39, 40, 41, 45; 73/195, 112

[56] References Cited

U.S. PATENT DOCUMENTS

| | | | |
|---|---|---|---|
| 3,323,365 | 6/1967 | Goetz | 73/195 |
| 3,593,578 | 7/1971 | Farrell | 374/40 |
| 3,918,300 | 11/1975 | Weisstuch et al. | 73/112 |
| 4,036,051 | 7/1977 | Fell et al. | 374/39 |
| 4,285,302 | 8/1981 | Kelly | 122/396 |

*Primary Examiner*—Edward G. Favore
*Assistant Examiner*—Steven E. Warner
*Attorney, Agent, or Firm*—Woodward, Weikart, Emhardt & Naughton

[57] ABSTRACT

A boiler blowdown heat recovery system is described herein which includes conduit means for directing the blowdown water and fresh water through a heat exchanger, and metering and display means are included for showing the volumetric flow of the blowdown water and the fresh water and also the energy in BTU's transferred to the fresh water. The present invention provides a distinct, packaged system which is readily mounted to a steam boiler or the like, and in a particular embodiment also includes a flash tank to provide for the recovery of additional steam from the blowdown water prior to passing the water through the heat exchanger.

2 Claims, 1 Drawing Figure

STEAM BOILER HEAT RECOVERY APPARATUS

BACKGROUND OF THE INVENTION

1. Field of the Invention

The present invention relates to an apparatus for the recovery of heat from a steam boiler, and more particularly to a unit which is useful in connection with a steam boiler to recover heat from the blowdown water.

2. Description of the Prior Art

A variety of devices and apparatus have been proposed in the prior art for measuring the amount of heat which is delivered to or received from a device. For example, in U.S. Pat. No. 4,250,747, issued to Diprose et al. on Feb. 17, 1981, there is disclosed a device for use with a hot water radiator system which measures the radiation from the system in units of 0.1 kilowatt-hours. The Diprose patent uses a flow rate measurement and two electrical resistance thermometers to determine the heat which is supplied by a radiator system, particularly for a hot water radiator system. The Diprose device is indicated for use with any electrically conductive fluid, including an electrolytic slurry.

Other systems which also include temperature sensors and flowmeters and provide a reading of heat in terms of units proportional to BTU's are disclosed in the U.S. Pat. Nos. 4,048,852, issued to Sakakibara et al. on Sept. 20, 1977 and 3,971,252, issued to Onoda on July 27, 1976. In the Sakakibara device, there is used a rotating vein flow meter with intermittent measurement being used after a predetermined volume of flow. The read out is only proportional to the heat supplied, such as a value of temperature differential times the number of units of volume, and the purpose is expressed as a low power requirement enabling battery operation. The Sakakibara patent describes an apparatus for the measurement of heat energy from supply equipment and heat used by load equipment, and particularly describes a measurement of heat supplied to dwellings in a housing area. The Onoda patent describes an electronic integration colorimeter which employs an impeller flowmeter, and the read out is in proportion to the production of heat. The Onoda patent provides a system for measuring the heat absorbed or provided by cooling or heating fluid passing through a device such as an air conditioner.

Devices have also been proposed in the prior art which include temperature sensing and flow metering coupled with a reading of heat supplied or received in terms of BTU's. Examples of such devices are contained in U.S. Pat. Nos. 4,224,825, issued to Feller on Sept. 30, 1980; 3,593,578, issued to Farrell on July 20, 1971; and 3,301,049, issued to Meyerson on Jan. 31, 1967. The Feller patent describes the measurement of heat absorbed by a solar heat absorber. The Feller device is apparently most interested in solar heating efficiency with the primary feature being to compensate for temperature dependent variables in density and specific heat. The read outs for the Feller unit are in heat absorbed over a period of time, or heat absorbed per unit of time, and there is stress as to the circuitry employed to compensate for temperature dependencies. The Farrell patent has a particular purpose in improved temperature sensing, and gives read outs of temperature, BTU's and flow in gallons. The Farrell patent provides a mechanical metering system which measures the heat transferred relative to a heat device such as a heat exchanger. The Meyerson device uses a standard drive shaft flowmeter, and gives a read out as to temperature difference, BTU output and flow in gallons. The metering of heat supplied or removed by a heating or cooling device, in particular measuring the heat radiated as the primary use of the device, is described in the Meyerson patent.

In the field of steam boilers, it is known in the prior art that the water within the boiler which remains after steam has been generated will receive a concentrating effect of the minerals and other contaminants of the water which will not pass into the steam phase. It is therefore the practice to periodically "blowdown" this dirty water in order to minimize this concentrating effect. This blowdown water is replaced with clean or fresh water which naturally is cooler than the water which was in the boiler. It is therefore also the practice in the prior art to pass this blowdown water through a heat exchanger to impart some of this heat to the fresh water which is being added to the boiler. Blowdown control systems are known which will blowdown or eliminate a certain amount of boiler water in response to a monitoring of the conditions within the boiler. These units may include a flowmeter to indicate the flow of the blowdown water from the boiler.

In contrast, the present invention provides a unit which readily and advantageously accomplishes several functions and does so in an economical and convenient fashion. Unlike the prior art devices such as those described, the present invention provides for a measurement of the flow rate and volume of blowdown water and replacement water, and also a measurement of the heat energy transferred from the blowdown water to the fresh water, particularly in units of BTU's.

SUMMARY OF THE INVENTION

In one aspect of the present invention there is provided an apparatus for the recovery of heat energy from a steam boiler, which apparatus includes conduit means for discharging the blowdown water and for adding fresh water, a heat exchanger for transferring heat energy from the blowdown water to the fresh water, and measurement and metering means for displaying the volumetric flow of the blowdown water and fresh water as well as the amount of heat energy added to the fresh water.

It is an object of the present invention to provide an apparatus which transfers heat energy from the blowdown water from a boiler to fresh water added to the boiler.

Another object of the present invention is to provide an apparatus which measures and displays important parameters in conjunction with the blowdown of water from a boiler.

It is a further object of the present invention to provide an apparatus which is readily attached to a steam boiler, particularly as a separate unit, to facilitate the blowdown operation.

Further objects and advantages of the present invention will become apparent from the description of the preferred embodiment which follows.

DESCRIPTION OF THE PREFERRED EMBODIMENT

Figure 1:
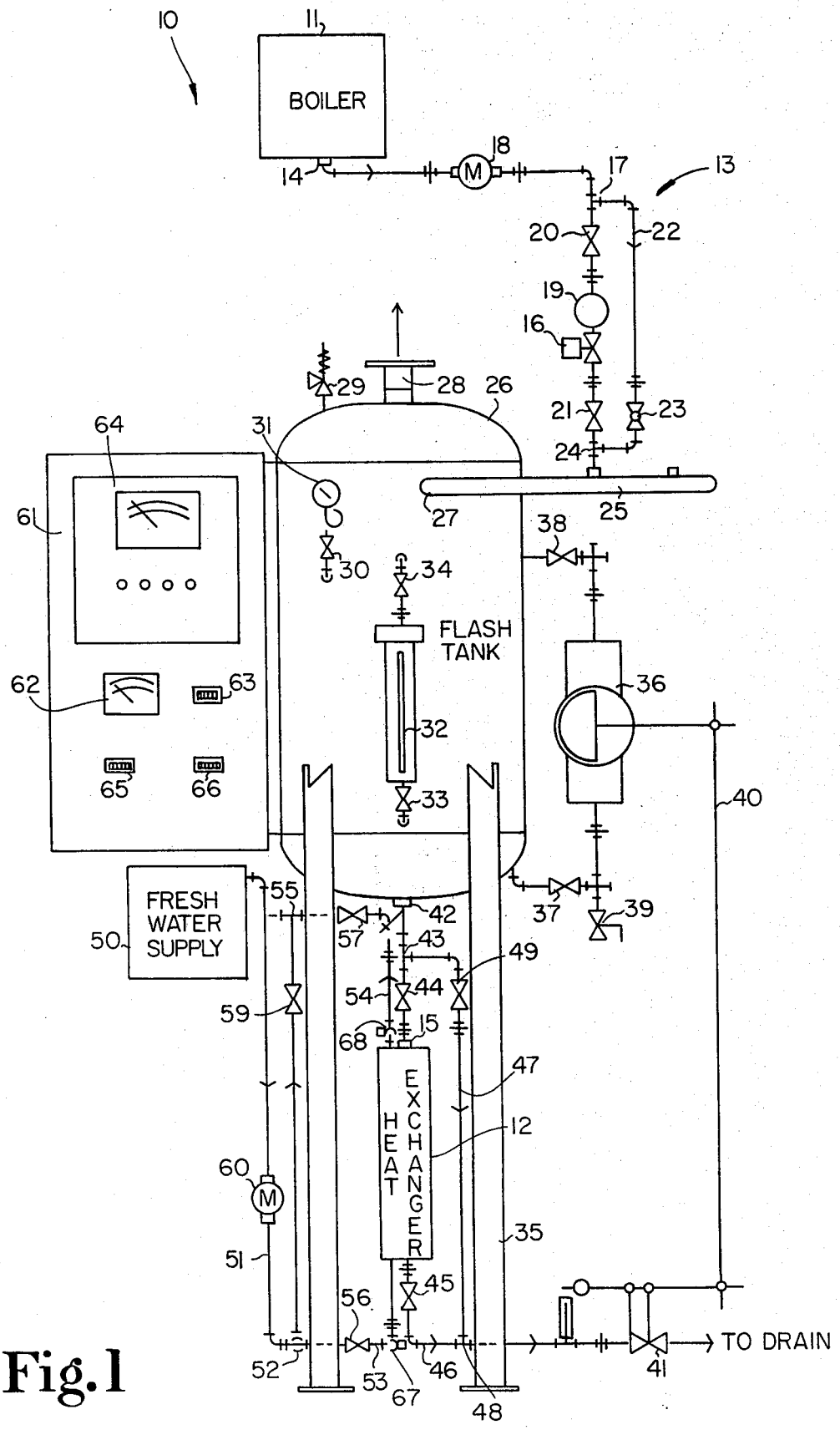
FIG. 1 is a schematic drawing of a boiler blowdown apparatus constructed in accordance with the present invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to the drawing, there is shown a boiler blowdown apparatus which is constructed in accordance with the present invention. The apparatus is shown somewhat in schematic form and is represented as being attached to a steam boiler. There is also shown the additional apparatus of a flash tank which is frequently used in conjunction with certain types of steam boilers to obtain additional steam from the blowdown water. The function and design of flash tanks is well known in the prior art, and therefore only a limited description of the flash tank is provided herein. It will be appreciated that the remaining portions of the apparatus shown in the drawing would be equally useful with a steam boiler by means of a direct connection with the boiler, rather than connections through the flash tank. It is further evident from the drawing that the connection of the remaining portions of the apparatus to the boiler could be accomplished in the exact manner as shown with the connections to the boiler taking the place of the connections to the flash tank, and with the use also of the appropriate valving, etc. in accordance with known constructional techniques.

As shown in the drawing, the present invention provides an apparatus 10 for recovery of heat energy from steam boiler water. As a first portion, the apparatus 10 includes a blowdown water conduit means for conveying blowdown water from a boiler 11 to a heat exchanger 12. The blowdown water control means 13 is provided for controlling the discharge of blowdown water through the blowdown water conduit means in the boiler. This blowdown water passes through the blowdown water conduit means from an inlet 14 connectable to the boiler and eventually to an outlet 15 connectable to the heat exchanger. As a portion of the blowdown water control means, there is provided a valve 16 to regulate the flow of the blowdown water from the boiler to the heat exchanger. It will be appreciated that the system could include essentially direct connection of the coil to the heat exchanger in the most simplified form of the blowdown water control means, but it is preferable to include additional equipment, as for example the flash tank which has been previously mentioned.

From the boiler, the flash down water passes through pipelines or the like to a T-junction 17. A flowmeter 18 is included in the line prior to the T-junction to permit a measuring of the volumetric flow of blowdown water through the conduit means. From the T-junction 17, two separate flow paths are provided. One flow path from the T-junction 17 is through a conductivity sensor 19 located in the flow path immediately upstream of the control valve 16. The conductivity sensor in accordance with known operation is used to detect the conductivity of the water which in turn is a measure of the amount of minerals or other contaminants in the water which would affect conductivity. In this fashion, the amount and timing of blowdown from the boiler is controlled to prevent an undesirable condition of mineral buildup or the like in the boiler water. Valves 20 and 21, preferably gate valves, are positioned on either side of the sensor 19 and control valve 16 to permit a manual control of the flow of blowdown water thrpough this path, and also to facilitate servicing of the sensor and control valve 16.

Also from the T-junction 17 there is provided a separate by-pass flow path 22 which includes a valve 23, also preferably a globe valve. The bypass line 22 may be used as a manual blowdown system, or otherwise to facilitate servicing of the sensor 19 and control valve 16. Both of these flow paths are joined at a second T-junction 24 which feeds into a blowdown manifold 25. The manifold 25 serves the purpose of permitting connection to several boilers for a single heat exchanger 15, or in particular for a single combination flash tank and heat exchanger. Each of the boilers would preferably have a blowdown control system such as that shown at 13.

As previously indicated, the blowdown conduit means may directly connect with the heat exchanger, or alternatively can connect with a flash tank. As shown in the drawings, there is provided a flash tank 26 with which the blowdown manifold 25 connects, preferably by means of a tangential entry 27. The flash tank in itself does not form any part of the present invention, but a brief description will be provided herein. The flash tank serves to derive additional steam from the blowdown water. This steam passes from the flash tank through the outlet 28 to a suitable steam system. A pressure relief valve 29 is provided on the tank as a safety device, or as a means to manually relieve the pressure on the tank as desired. A line connected with the flash tank and including a valve 30 is connected with a flash steam pressure gauge 31 to monitor the pressure within the tank. A sight glass 32 is also provided which connects through a line having valves 33 and 34 connected with the tank to thereby permit visual monitoring of the level of water within the tank. The flash tank is supported by several upstanding legs 35 which may be affixed to the floor as required.

A blowdown level controller 36 is connected with the flash tank and includes valves 37 and 38 interposed in the line between the flash tank 26 on either side of the level controller 36. The level controller 36 acts in accordance with usual operation to control the water level in the flash tank, and the function is therefore not described in detail herein. There is provided a quick opening blowdown valve 39 to permit direct and rapid fluid level control. The level controller 36 is also connected, as shown schematically by line 40, with a blowdown level control valve 41 to provide for controlling the fluid level within the flash tank by operation of the valve 41. The control valve 41 is located in the discharge line for the blowdown water exiting the heat exchanger, and the control of fluid flow through that line will therefore directly control the level of fluid within the flash tank.

At the bottom of the flash tank 26 there is provided an outlet 42 for passage of the blowdown water from the flash tank either directly to a drain, or through a heat exchanger and then to the drain. A T-junction 43 connects with the outlet 42 and provides alternate paths for the blowdown water from the flash tank either through the heat exchanger or through a bypass directly to the drain. A valve 44 is positioned in the line connecting from the T-junction 43 to the heat exchanger 12, and a second valve 45 is located in the line exiting from the heat exchanger. This flow line 46 includes the blowdown control valve 41, and leads to an appropriate drain for the blowdown water. Alternately, there is provided a bypass line 47 which extends from the T-junction 43 to a second T-junction 48 in the drain line 46. A valve 49 is provided in the bypass line 47 to provide for control of the flow of the blowdown water through the bypass line.

The apparatus 10 also includes a fresh water supply source 50 which feeds through line 51 to a T-junction 52. From the T-junction 52, two separate flow paths are provided. One of these flow paths extends through a supply line 53 into the heat exchanger 12. The outlet line 54 extends from the fresh water outlet of the heat exchanger to a T-junction 55. Valves 56 and 57 are positioned in the lines 53 and 54, respectively, on either side of the heat exchanger 12 to control flow of fresh water through the heat exchanger. As an alternative flow path, a line 58 having valve 59 provides a direct connection between T-junction 52 and T-junction 55, thus acting as a by-pass line for the fresh water around the heat exchanger 12. The T-junction 55 then connects to the boiler either directly or through a return tank, or in certain applications would return through a deaerator.

As thus described, there is provided a fresh water conduit means for conveying fresh water from a water supply to the heat exchanger. The fresh water conduit means is shown to include an inlet connectable to the water supply and an outlet connectable to the heat exchanger. Fresh water control means are also provided for controlling the flow of fresh water through the fresh water conduit from the water supply. For example, the valves 56 or 57 may be used to control the flow of water through the heat exchanger, or the valve 59 may be used to control the flow of water through the bypass line 58. Other types of water control means may be employed, such as controls which would relate the entry of fresh water to the level of water in the boiler, the amount of water discharged through the blowdown line from the boiler, or any other desired parameter or condition. Also, a water meter 60 is positioned in the fresh water supply line 51 to measure the volumetric amount of water flow from the fresh water supply.

From the above description, it is apparent that the heat exchanger 12 includes a first flow path for the blowdown water which enters at the inlet 15 and is discharged through the line 46. The inlet 15 is connected with the outlet of the blowdown water conduit means, and more particularly may connect either directly with the boiler, at some intermediate point from the boiler, or after the flash tank as particularly shown in the drawings. The heat exchanger 12 also includes a second flow path having an inlet connected with the outlet of the fresh water conduit means, and an outlet connectable with the boiler. Also as described, the fresh water outlet of the heat exchanger may connect directly with the boiler or may have an intermediate connection with a deaerator or other piece of equipment.

As also shown in the drawing, there is provided a control panel 61 which forms an integral part of the present invention. There is a flow measurement means for measuring the volumetric flow of the blowdown water, as shown by the flowmeter 18. It will be appreciated that the volumetric measurement of the blowdown flow water may be accomplished at various places along the system depending upon the particular arrangement which is used. As shown in the drawings and when used in conjunction with the flash tank, it is desirable to measure the flow of blowdown water in the blowdown water conduit means prior to the flash tank 26. This of course is due to the fact that a portion of the water is lost as steam in the flash tank, and a measurement below the flash tank would not give an accurate reading of the amount of water blown down from the boiler. When a flash tank is not used, it may be equally desirable to measure the volumetric flow of blowdown water adjacent or intermediate the heat exchanger. The flow measurement means is also provided for measuring the volumetric flow of fresh water. Again, this measurement may take place at various points appropriately selected within the particular system used, and as shown in the drawing may be accomplished in the fresh water supply line 51 by means of the flow meter 60. The volumetric flow may be measured either in the fresh water conduit means or in the heat exchanger as shown.

The blowdown flowmeter 62 operates in standard fashion to show the volumetric flow rate of the blowdown water as monitored by the flowmeter 18. There is also preferably provided a blowdown flow counter 63 which also forms a portion of the blowdown meter means and displays a cumulative count of the amount of blowdown water over a determined period of time in terms of gallons. A blowdown controller 64 is also provided to permit manual and/or automated control of the blowdown water, and for example is preferably connected with the conductivity sensor 19 and control valve 16 to operate the blowdown process. There is also provided a flow counter 65 which operatively connects with the flow meter 60 and displays a cumulative amount of the fresh water supplied to the system in units of gallons. Similarly, a meter or counter 66 is provided to display the cumulative amount of energy which is absorbed by the fresh water passing through the heat exchanger. This energy absorption is preferably displayed in units of BTU's, and is determined by the use of remote temperature detectors 67 and 68 positioned to monitor the temperature of the fresh water as it enters and leaves the heat exchanger, respectively.

It will be appreciated that various means could be used to assess the amount of energy transfer through the heat exchanger. In the preferred method, the heat detector 67 and 68 are used to determine the temperature rise of the freshwater as it passes through the heat exchanger 12. Alternatively, a fairly accurate assessment could be made by measuring the decrease in temperature of the blowdown water as it passes through the heat exchanger, although some of this heat loss would be attributable to a general heat loss from the heat exchanger, and not to a transfer to the fresh water. Thus, other means could be used to determine the BTU's absorbed by the fresh water but the most direct and therefore preferred method is to monitor the temperature increase of the fresh water. Similarly, other metering and display means could be used in conjunction with the present invention. Although counters have been shown for use in monitoring the amount of fresh water in gallons and also the energy transferred to the fresh water, there could also be included the use of meters which would give a more instantaneous display. The operation of these various meters and display units are conventional in the art, and a detailed description is therefore not included.

While the invention has been illustrated and described in detail in the drawing and foregoing description, the same is to be considered as illustrative and not restrictive in character, it being understood that only the preferred embodiment has been shown and described and that all changes and modifications that come within the spirit of the invention are desired to be protected.

What is claimed is:

1. A steam boiler blowdown heat recovery apparatus which comprises:

blowdown water conduit means for conveying blowdown water from a boiler to a heat exchanger, said blowdown water conduit means including an inlet connectable to the boiler and an outlet connectable to the heat exchanger;

fresh water conduit means for conveying fresh water from a water supply to a heat exchanger, said fresh water conduit means including an inlet connectable to the water supply and an outlet connectable to the heat exchanger;

blowdown water control means for controlling the discharge of blowdown water through the blowdown water conduit means from the boiler to the heat exchanger;

fresh water control means for controlling the flow of fresh water through the fresh water conduit means from the water supply to the heat exchanger;

a heat exchanger including a first flow path for the blowdown water and a second flow path for the fresh water, the first flow path having an inlet connected with the outlet of said blowdown water conduit means, the second flow path having an inlet connected with the outlet of said fresh water conduit means and an outlet connectable with the boiler;

blowdown water flow measurement means for measuring the instantaneous volumetric flow of blowdown water from said boiler through said blowdown water conduit means and through said heat eschanger;

fresh water flow measurement means for measuring the instantaneous volumetric flow of fresh water from said water supply through said fresh water conduit means and through said heat exchanger;

flow meter display means for displaying the instantaneous volumetric flow of blowdown water and of fresh water as measured by said blowdown water flow measurement means and said fresh water flow measurement means, respectively;

energy measurement means for measuring the amount of energy transferred in said heat exchanger from the blowdown water to the fresh water; and energy meter display means for displaying the amount of energy transferred from the blowdown water to the fresh water as measured by said energy measurement means.

2. The apparatus of claim 1 in which said energy measurement means includes first temperature measurement means for measuring one of (a) the temperature of the fresh water entering said heat exchanger or (b) the temperature of the blowdown water exiting said heat exchanger, and second temperature measurement means for measuring one of (a) the temperature of the fresh water exiting said heat exchanger or (b) the temperature of the blowdown water entering said heat exchanger.

* * * * *